US006848575B2

(12) United States Patent
Ueno et al.

(10) Patent No.: US 6,848,575 B2
(45) Date of Patent: Feb. 1, 2005

(54) FASTENING ELEMENT

(75) Inventors: Hideyuki Ueno, Kanagawa (JP); Akihiro Goto, Aichi (JP)

(73) Assignees: Kotec's Co., Ltd., Tokyo (JP); Sanyo Seisakusho Co., Ltd., Nagoya (JP)

( * ) Notice: Subject to any disclaimer, the term of this patent is extended or adjusted under 35 U.S.C. 154(b) by 0 days.

(21) Appl. No.: 10/347,167

(22) Filed: Jan. 17, 2003

(65) Prior Publication Data

US 2003/0137154 A1 Jul. 24, 2003

(30) Foreign Application Priority Data

Jan. 18, 2002 (JP) ..... 2002-009874

(51) Int. Cl.[7] ..... B65D 85/24
(52) U.S. Cl. ..... 206/343; 206/345; 206/820
(58) Field of Search ..... 206/338, 343–346, 206/820; 24/16 PB, 30.5 P, 704.2; 292/321, 322, 318, 319

(56) References Cited

U.S. PATENT DOCUMENTS 5,908,110 A * 6/1999 Hirai ..... 206/345
6,561,350 B1 * 5/2003 Ueno ..... 206/343
6,595,360 B2 * 7/2003 Ueno et al. ..... 206/343

FOREIGN PATENT DOCUMENTS

| | | |
|---|---|---|
| EP | 0 002 619 | 6/1979 |
| EP | 1 083 537 | 3/2001 |
| EP | 1 088 762 | 4/2001 |

* cited by examiner

*Primary Examiner*—Luan K. Bui
(74) *Attorney, Agent, or Firm*—Greer, Burns & Crain, Ltd.

(57) ABSTRACT

A plurality of fastening elements are arranged parallel to each other, each of the unit fastening elements having a filament section, an inserting head section equipped with a suitable engagement section at one end, and a socket section equipped with a hole for irreversibly passing the inserting head section located at the other end. The socket sections arranged on one connection bar, and the inserting head sections are arranged on another connection bar. The connection bars are closely arranged to each other so as to be oppositely disposed to each other with a predetermined length displaced to each other along a longitudinal direction of the bars. The filament section of each one of the unit fastening elements is formed in a curved configuration which is in fixed condition, so jamming is reduced when the operator couples the fastening element using a coupler gun.

21 Claims, 13 Drawing Sheets

FASTENING ELEMENT

BACKGROUND OF THE INVENTION

1. Field of the Invention

The present invention relates to a fastening element for sealing after attaching tags such as brand labels, price labels, material descriptions, instruction manuals, etc., to products such as garments, shoes, bags, etc. In particular, the present invention relates to a fastening element whose filament section does not get entangled when the fastening element is set to a special-purpose device (gun) for attaching the tags.

2. Description of the Related Art

In general, for binding garments, ladies boots, sandals, shoes, etc. or for attaching brand labels, price labels, etc. to the products, a fastening element 4 as shown in FIG. 5 has been used.

In FIG. 5, the fastening element 4 comprises a plurality of unit filament sections 20 each of which being arranged in parallelism with each other and being integrally and fixedly held to each other.

One example of each one of the unit fastening elements 20 is shown in FIG. 6.

Note that, as shown in FIG. 6, each one of the unit fastening element 20 comprises a filament section 5 that forms a loop by passing the tag, an inserting head section 6 mounted on one end of the filament section and equipped with an appropriate step like portion or a hooked portion 9, and a socket section 8 mounted on the other end of the filament section 5 and provided with a hole 7 for passing the inserting head section 6 and being provided with a blade member 19 therein, the blade member 19 being able to engage with the step-like portion 9 of the inserting head section 6so as to irreversibly fix the inserting head section 6 in the hole 7.

A plurality of unit fastening elements 20 are temporarily fixed to two connection bars 11, 11' so that the unit filament section 20 are kept in parallel with each other.

An embodiment of the fastening element 4 of the present invention as shown in FIG. 5, is formed integral preferably with synthetic resin, etc., and in particular, the filament section 5 is drawn and is extremely resistant to tension.

As shown in FIG. 6(C), when the inserting head section 6 is inserted and passed through the hole 7 of the socket section 8, the blade portion 19 which is provided inside the hole 7 of the socket section 8, is displaced outwardly so that the step-like portion 9 of the inserting head section 6 is engaged with the blade portion 19 to make the inserting head section 6 being irreversibly fixed inside the socket section 8, and the loop-form label fixing condition is completed so that sealing is achieved.

Conventionally, these fastening elements 4 are loaded on the special-purpose coupler gun (attaching gun) 10 as shown in FIG. 7, and have been used not only for binding boots, sandals, or shoes but also primarily for fixing the brand label or tag T describing the directions for use to products by using an operation lever.

However, with the conventional fastening element 4, over all the fastening element including the filament sections is simply formed in a flat surface configuration, and thus when the fastening element 4 is mounted on the attaching gun 10, it is necessary for an operator to bend the filament section 5 by hand so that the inserting head section 6 and the socket section 8 are closed to each other, and such operation arises various difficulties for the operator.

For example, as shown in FIG. 7, when the fastening element 4 is mounted on the attaching gun 10 enabling to fasten a label, a tag or the like to a good, by operating the lever 18 of the attaching gun 10 so that a plurality of the unit fastening elements 20 is continuously attached to each one of predetermined goods, respectively, the operator is required to do operations in that the fastening element 4 is first bent with a relatively large force and then the connection bar 11' to which the inserting head section 6 are connected, is inserted into an insertion slit 31 mainly used for the connection bar 11', after that, the connection bar 11 to which the socket section 8 are connected, is inserted into an insertion slit 32 mainly used for the connection bar 11.

This connection bar inserting operation is usually very heavy work and further it is also difficult operation in which the operator holds the attaching gun 10 with his one hand while setting the fastening element 4 on the gun 10 with his other hand.

However, with the conventional fastening element, when a plurality of the filament sections 5 each being arranged in the plane condition and in parallel to each other, are mounted on the attaching gun 10 with making the filament sections 10 into curved configuration and are used successively one by one, the curved configuration portions of each one of the filament sections 5 each being adjacently arranged to each other, are frequently entangled with each other causing jamming condition on the fastening elements attaching gun due to such entanglement thereof.

Further, since it is difficult to identify a front surface or a back surface of the fastening element 5 when the filament sections of the fastening element 5 having a flat configuration should be bent, the fastening element 5 is sometimes erroneously bent in an opposite direction, causing the attaching gun 10 to malfunction.

And further, when the filament sections 5 arranged in a flat configuration, are bent, since the filament sections 5 are relatively hard and there must be a limit in radius of curvature to be bent, a width of the attaching gun cannot be sufficiently narrowed.

On the other hand, a plurality of the fastening element 4 as shown in FIG. 5, are stacked with each other and inserted into a predetermined package with this stacked condition.

And when this package is transferred to a prescribed working place at which each one of the fastening elements 4 is picked up from the package, each one of the filament sections 5 of one fastening element 4 are entangled with the inserting head section 6 or the socket section 8 of other fastening element 4 adjacently arranged thereto and thus when one fastening element 4 is about to be picked up from the package, a plurality of other fastening elements 4 are simultaneously withdrawn from the package and thus a significant extra operation is required to separate them each other causing the operation cost to be increased.

In order to avoid this problem, appropriate sheets or appropriate separating member should be inserted into a space formed between the fastening elements 4 adjacently arranged to each other and thus this method also causes to increase the production cost.

And further, in order to resolve this problem in the past, the applicant has already provided a new method in that the filament sections 5 should be positively bent in curved condition or folded to make folded portion on the filament as shown in Japanese Patent Application Number 11-39473.

Note that, as shown in FIGS. 12 to 14, at around a center-portion of the filament section 5 of each one of the unit fastening elements of the fastening element 4, a curve-like portion 34 or a folded portion 35 is positively formed or a portion 36 which can be easily bent or a portion 36 which can be easily folded is also positively formed thereat.

By using the above-mentioned method, the operation for mounting the fastening element 4 on the attaching gun 10 as shown in FIG. 7, has been improved but however, a distance formed between the curve-like portion 34 or the folded portion 35 of one filament section 5 of the fastening element 4 and that of another filament section 5 adjacently arranged thereto, is easily changed and thus it is acknowledged that during a time when each one of the unit fastening elements mounted on the attaching gun 10 is shot successively, the filament sections 5 adjacently arranged to each other are entangled with each other causing to generate the jamming condition.

Further, in the above-mentioned conventional technology, when each one of the unit fastening elements 20 of the fastening element 4 which is mounted on the attaching gun 10, is shot, respectively, a distance formed between the free end portions of the upper most end portion of each one of the pair of the connection bars 11, 11', is expanded causing to be a reason for generating the jamming condition as well as to be an obstruction to eye for an operator to work the label attaching operation so that working efficiency thereof is reduced.

Accordingly, it is a first object of the present invention to provide a fastening element that enables to improve the working efficiency for mounting the fastening element in which a plurality of the unit fastening elements are arranged in parallelism with each other and being integrally and fixedly arranged to each other with appropriate connecting bars, on a device mainly used for the fastening element, as well as to provide a fastening element that enables to prevent each of the unit fastening elements from being jammed or entangled with each other.

Further, it is a second object of the present invention to provide a fastening element each one of which can be easily taken out singly, from a package when the fastening elements are contained into a package, and to provide a package for containing and transferring the fastening elements.

SUMMARY OF THE INVENTION

In order to solve the problems to be solved as mentioned above, the present invention basically adopts the configuration as recited below. That is, the first aspect of the present invention relates to a fastening element comprising a plurality of a unit fastening element arranged adjacently and in parallelism with each other, each of the unit fastening element comprising a filament section, an inserting head section equipped with a suitable engagement section located at one end of the filament section, and a socket section equipped with a hole for irreversibly passing the inserting head section located at the other end of the filament section, the fastening element characterized in that a plurality of the socket sections or their vicinities each being adjacently arranged to each other and a plurality of the inserting head sections or their vicinities each being adjacently arranged to each other, are temporarily and individually connected to each one of connection bars, respectively, and further each of the connection bars are closely arranged to each other so as to be oppositely disposed to each other with a predetermined length displaced to each other along a longitudinal direction of the both connection bars and further the filament section of each one of the unit fastening elements being formed in curved configuration which is in fixed condition.

The second aspect of the present invention relates to a package for containing fastening elements wherein a plurality of the above-mentioned fastening elements.

BRIEF DESCRIPTION OF THE DRAWINGS

Table 1 is a table showing the results of tests performed with the present invention, compared with tests performed with conventional devices.

DETAILED DESCRIPTION OF THE PREFERRED EMBODIMENTS

As mentioned above, the fastening element according to the present invention is characterized in that a fastening element comprising a plurality of a unit fastening element arranged adjacently and in parallelism with each other, each of the unit fastening element comprising a filament section, an inserting head section equipped with a suitable engagement section located at one end of the filament section, and a socket section equipped with a hole for irreversibly passing the inserting head section located at the other end of the filament section, the fastening element characterized in that a plurality of the socket sections or their vicinities each being adjacently arranged to each other and a plurality of the inserting head sections or their vicinities each being adjacently arranged to each other, are temporarily and individually connected to each one of connection bars, respectively, and further each of the connection bars are closely arranged to each other so as to be oppositely disposed to each other with a predetermined length displaced to each other along a longitudinal direction of the both connection bars and further the filament section of each one of the unit fastening elements being formed in curved configuration which is in fixed condition.

And further, the fastening element of the present invention is preferably configured so that a flat surface formed by each one of the curved configuration of each one of the filament sections is set either substantially in parallelism with the longitudinal direction of the both connection bars or with a predetermined angle with the longitudinal direction thereof.

In addition to thereabout, the fastening element of the present invention is further preferably configured so that at least a part of the curved configuration formed by each one of the filament sections is overlapped with at least a part of the curved configuration of other filament section adjacently arranged thereto each other.

Referring now to drawings, the configuration of one specific example of the fastening element according to the present invention will be described in detail.

Figure 1:
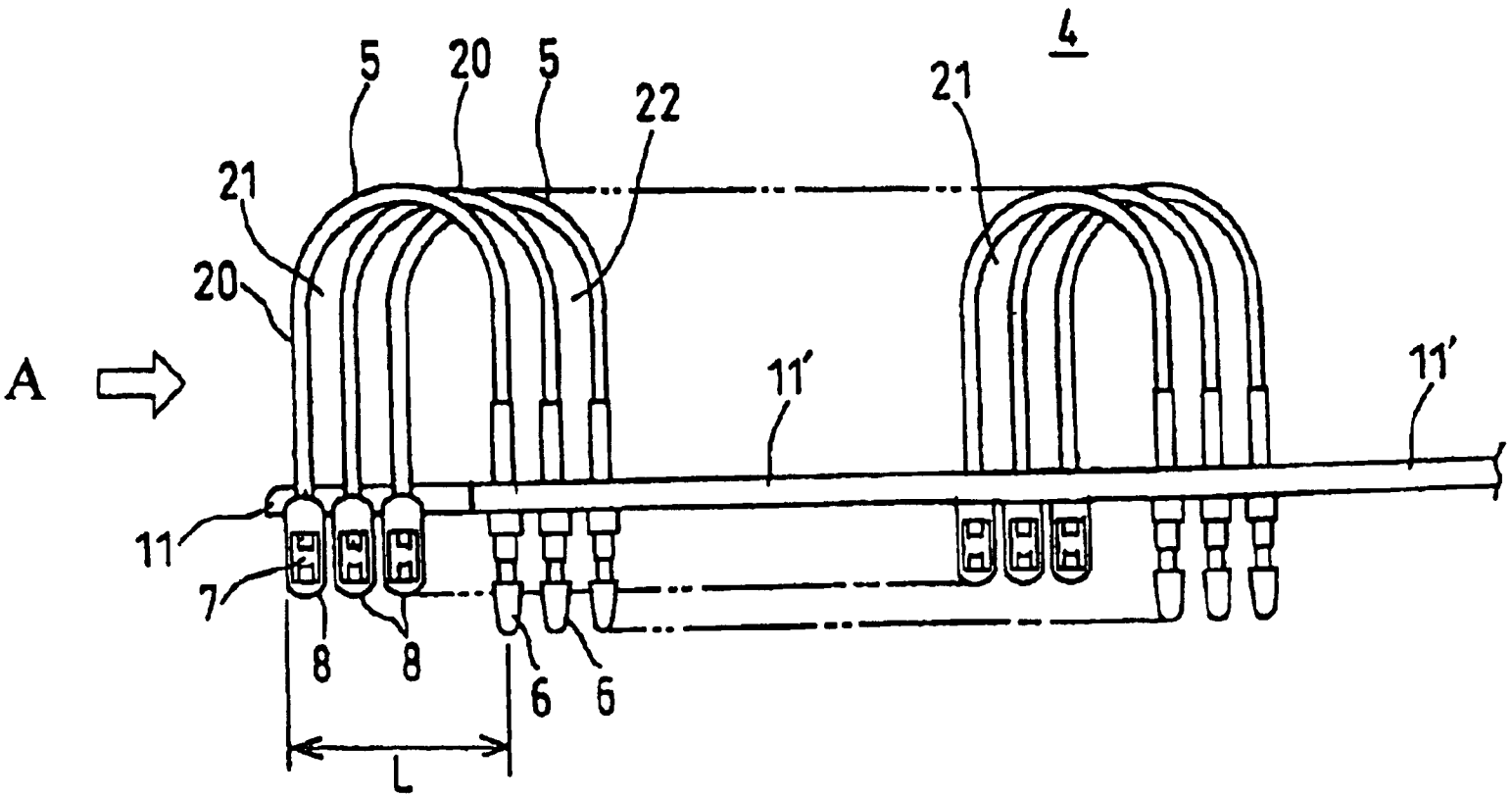
FIG. 1 is a plan view showing one embodiment of a fastening element of the present invention.
Figure 2:
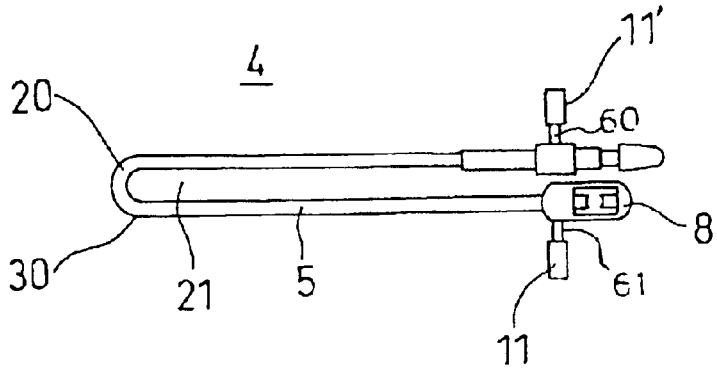
FIG. 2 is a cross-sectional view showing the above-mentioned fastening element in FIG. 1, taking along the arrow direction.
Figure 3:
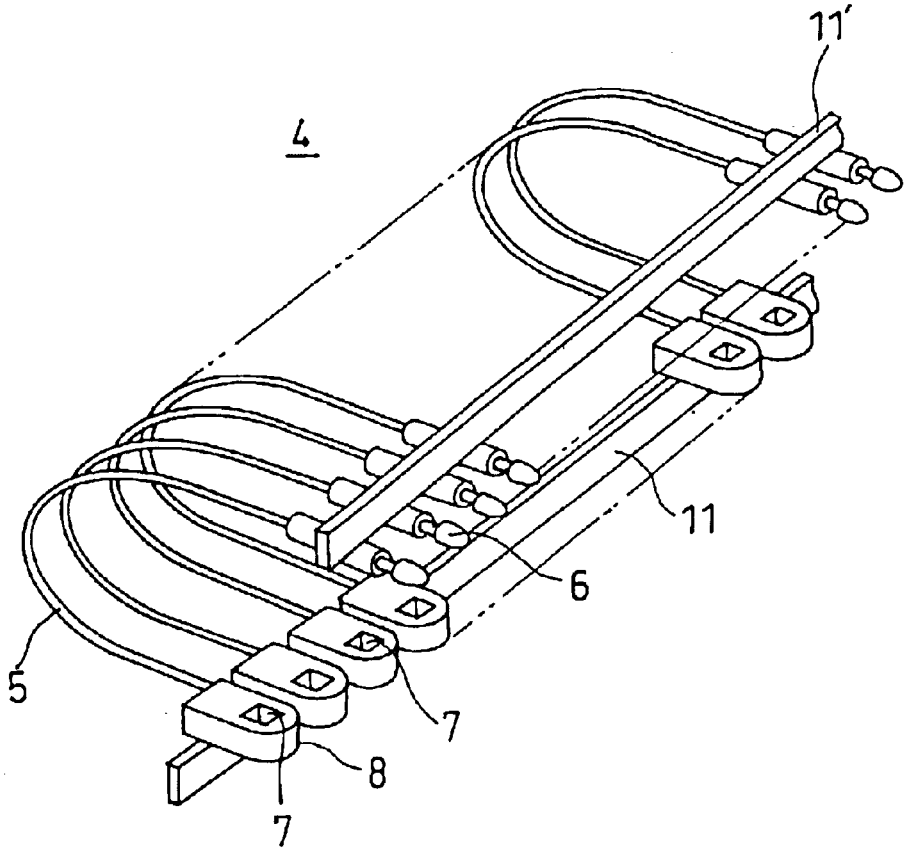
FIG. 3 is a perspective view showing the above-mentioned fastening element.

That is, FIG. 1 is a view showing a configuration of one example of the fastening element according to the present invention. In FIG. 1, it is shown that a fastening element 4 comprising a plurality of a unit fastening elements 20 arranged so that each one of the filament sections 5 being adjacently and in parallelism with each other, each of the unit fastening element 20 comprising a filament section 5, an inserting head section 6 equipped with a suitable engagement section located at one end of the filament section 5, and a socket section 8 equipped with a hole 7 for irreversibly passing the inserting head section 6 located at the other end of the filament section 5, the fastening element 4 characterized in that a plurality of the socket sections 8 or their vicinities each being adjacently arranged to each other and a plurality of the inserting head sections 6 or their vicinities each being adjacently arranged to each other, are temporarily and individually connected to each one of connection bars 11 and 11', respectively, and further each of the connection bars 11 and 11' are closely arranged to each other so as to be oppositely disposed to each other with a predetermined length displaced to each other along a longitudinal direction of the both connection bars 11 and 11' and further the filament section 5 of each one of the unit fastening elements 20 being formed in curved configuration which is in fixed condition.

Figure 4:
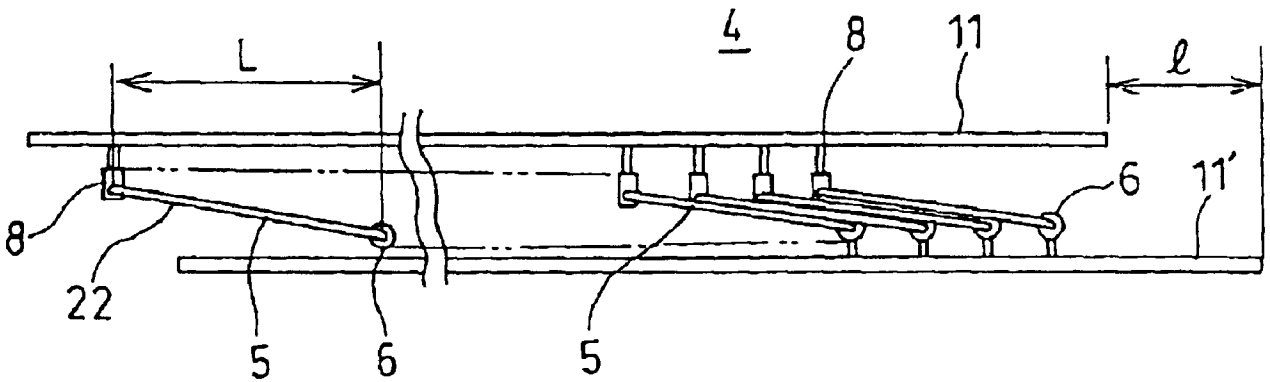
FIG. 4 is a side view showing the above-mentioned fastening element.

Further technical feature of the fastening element 4 of the present invention is, as shown in FIG. 4, such that a flat surface 22 formed by each one of the curved configurations 21 of each one of the filament sections 5 is set either substantially in parallelism with the longitudinal direction of the both connection bars 11 and 11' or with a predetermined angle with the longitudinal direction thereof.

The curved portion 21 of each one of the filament sections 5 in the fastening element 4 of the present invention, is preferably heat-set but it may be set in this predetermined configuration with utilizing an appropriate fixing substance.

Further, as a method for fixing the filament section 5 of the present invention, for example, it may be pressed by pressing the filament section 5 into a predetermined shape and by pressing it for a long time with keeping its configuration.

Or, another method can also be used in which after the filament section 5 is molded with drawing the same and during a time in which the filament section 5 has not yet been completely cooled, that is during a time in which the filament section 5 is still in a thermoplastic condition, after the both of the connection bars 11 and 11' being oppositely disposed to each other, are displaced with a predetermined length to each other along a longitudinal direction of the both connection bars 11 and 11', an appropriate pressing treatment is applied to the fastening element 5 so as to change each one of the filament sections 5 into a flat and curved form.

On the other hand, the fastening element 4 according to the present invention, the filament section 5 is preferably made of a synthetic material which can be set with heat.

Note that, the fastening element 4 according to the present invention is formed integral by nylon, polypropylene, polyester, or other synthetic resins, as the conventional fastening element.

In the present invention, a method for heating set the filament section 5 is not specifically restricted to that as mentioned above, but it may be a method as shown in FIGS. 10 and 11, in which the filament section 5 can be treated with a pressing operation utilizing a pressing plates heated at an appropriate temperature or a method in which the filament section 5 can be treated with a pressing operation utilizing a pressing plates which are not directly heated but the filament section 5 is heated with applying a heated air, an infrared beam or laser right beam thereto so that the filament section 5 becomes into a thermoplastic condition under which the filament section 5 is pressed.

In the present invention, an amount of a displacing distance L formed between the connection bars 11, 11' which are displaced along the longitudinal direction thereof each other, is not restricted to a specific value, but it can be set within a range of 5 to 30 mm and preferably within a range of 10 to 20 mm.

Precisely, a range of the amount of a displacing distance L formed between the connection bars 11, 11' is preferably set at a necessary length with respect to a material to be used for the fastening element 4 or a length of the filament section 5.

For example, if when a condition of the displacing distance L which is fallen within the above-mentioned range is adopted, it is possible that a pair of the connection bars 11 and 11' of the fastening element 4, each being oppositely arranged to each other, are able to maintain a stable and parallel condition under which both bars being overlapped with each other, and further, it is also possible that the filament section 5 of one fastening element 4 can maintain its stable condition with closely contacting with another filament section 5 of a separate fastening element 4 adjacently arranged to the fastening element.

In the present invention, if when an amount of the displacing distance L formed between both connection bars which is fallen below a minimum value of the above-mentioned range is adopted, a large force for bending a plurality of the filament sections 5 into curved configuration uniformly, is required and further even if the curved configuration had been formed on each one of the filament sections 5, each one of the filament sections 5 is not fixed at a stable position and thus a distance formed between the filament sections 5 each being adjacently arranged to each other is not uniform.

And when it is set during a heat setting operation, as mentioned below, since this non-uniformed condition among the filament sections 5 are also heat-set as they are, when each one of the filament section 5 is shot, respectively, the filament sections 5 each adjacently arranged to each other are entangled with each other so that so called jamming conditions are frequently generated making this kind of fastening element 4 un-useful fastening element.

Further, in the present invention, if when an amount of the displacing distance L formed between both connection bars which is fallen exceeding a maximum value of the above-mentioned range is adopted, a plurality of the filament sections 5 are not uniformly bent into a curved configuration, as well as the connection bars 11 and 11' are not set in parallelism with each other so that the bars show a something like a twisted condition and thus it becomes impossible to mount the fastening element 4 on the attaching gun 10.

And under this condition, even when a heat set treatment is applied to the fastening element 4, it is quite impossible for mounting the fastening element 4 on the gun 10 and even when the mounting operation would have succeeded, it is apparent that a shooting operation for each one of the filament sections 5 is difficult.

Further, in the present invention, it is preferable that when the both connection bars 11 and 11' are held in vertical direction, the most lowest end portion of one of the connection bars is put on a position below a position of the most lowest end portion of another connection bar.

On the other hand, in the fastening element 4 of the present invention, it is also a preferable embodiment in which a first guide portion 40 is provided at least at one end portion of the connection bar 11' to which a plurality of the inserting head sections 6 are connected, the first guide portion 40 having a predetermined length and to which none of the inserting head section 6 is connected.

While, it is also a preferable embodiment of the present invention, in which, the connection bar 11 to which a plurality of the socket sections 8 are connected, is provided with a second guide portion 41 having a predetermined length shorter than that of the first guide portion 40, and to which none of the socket section 8 is connected, at least at one end portion thereof or the connection bar 11 is not provided with the above-mentioned second guide portion 41 at least at one end portion thereof.

Figure 7:
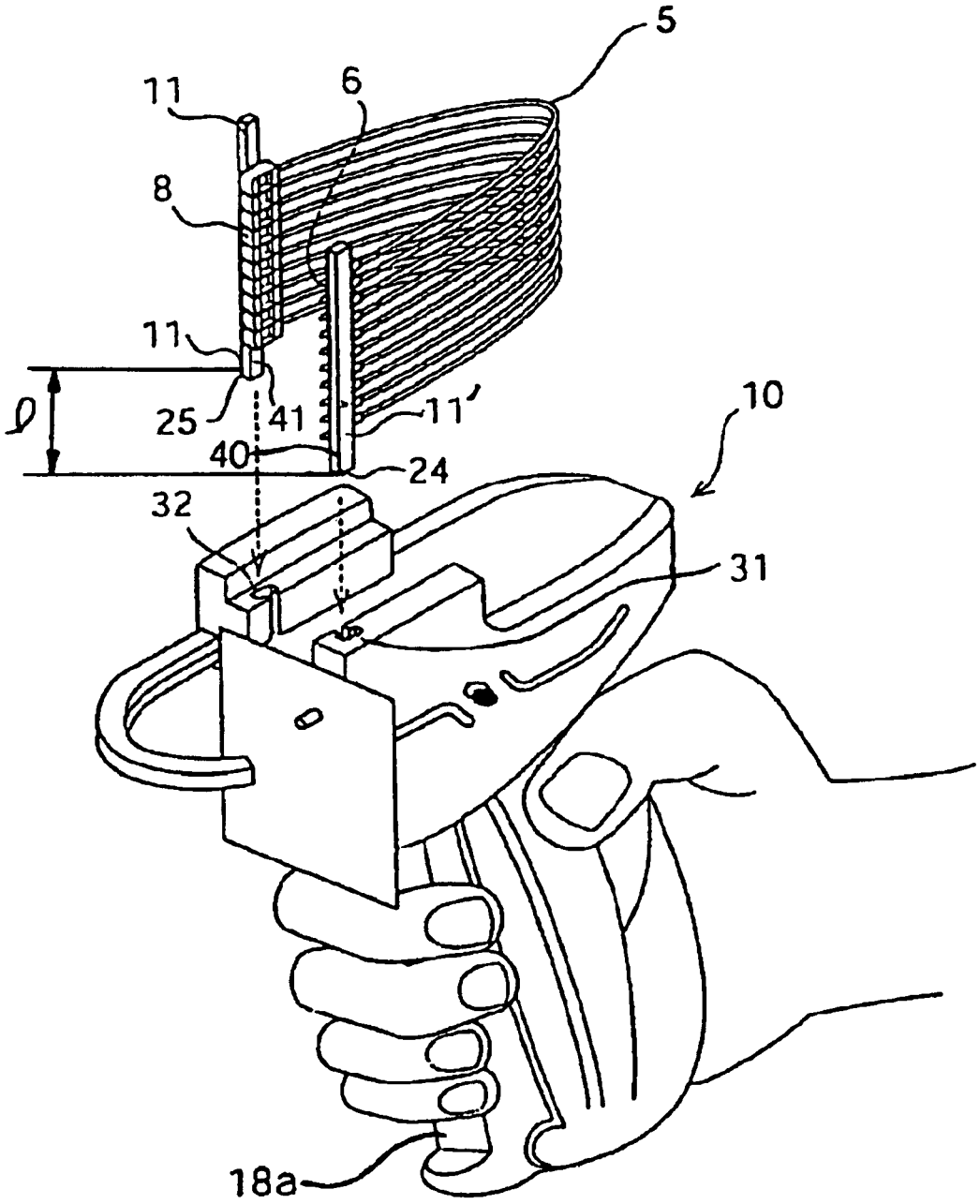
FIG. 7 is a perspective view showing an example in which the fastening element according to the present invention is mounted on the attaching gun.

More precisely, in the fastening element 4 of the present invention, as shown in FIG. 7, a position 24 of the most lowest end portion of the first guide portion 40 of the connection bar 11' to which the inserting head section 6 are connected, is preferably set at a position located below the most lowest end portion 25 of the second guide portion 41 of the first connection bar 11 to which the socket sections 8 are connected, by a length of 1, or in a case in which no second guide portion 41 is provided, a position 24 of the most lowest end portion of the first guide portion 40 is preferably set at a position located below the most lowest end portion 25 of the first connection bar by a length of 1.

On the other hand, in a case in which the guide portions 40 or 41 is not provided on the connection bar, when the both connection bars 11 and 11' are held in vertical direction, it is preferable that the position 24 of the most lowest end portion of the second connection bar 11' to which the inserting head section 6 are connected, is set at a position below the most lowest end portion 25 of the first connection bar 11 to which the socket sections 8 are connected.

Note that, in a case in which the fastening element 4 of the present invention is mounted on a conventional attaching gun 10 as shown in FIG. 7, and each one of the unit fastening elements 20 is respectively shot successively therefrom, it is also a preferable embodiment of the present invention, in that, when the fastening element 4 is held in a vertical direction, the most lowest end portion of the connection bar 11' to which the inserting head section 6 are connected, is previously designed to be located at a position below the most lowest end portion of another connection bar 11 to which the socket sections 8 are connected, and thereby it is possible to completely avoid a mistake in acknowledging an insertion direction as well as an insertion position for the lower end portion of the connection bar, when the fastening element 4 is mounted on the attaching gun 10.

In the present invention, when the above-mentioned guide portions 40 and 41 are provided on the connection bars 11 and 11' of the fastening element 4, respectively, the first connection bar 11 to which the socket sections 8 are connected, and the second connection bar 11' to which the inserting head sections 6 are connected, are surely inserted into each one of the connection bar insertion slits 31 and 32 into which each one of the connection bars should be inserted, respectively.

Further, as mentioned above, when the prescribed guide portions 40 and 41 are provided on each one of the connection bars, respectively, with making the respective length of each one of the guide portions different from each other, an operator can easily discriminate which connection bar is the connection bar to which the socket sections 8 are connected or which connection bar is the connection bar to which the inserting head sections 6 are connected, and accordingly, an occasion at which an insertion mistake is generated, will be surely avoided.

Note that, in the present invention, as shown in FIGS. 4 and 7, when the fastening element 4 is held in vertical direction, it is also preferable that a guide portion 40 is provided on the connection bar 11' to which the inserting head sections 6 are connected, by extending an lower end portion of the connection bar 11', downwardly from a position of the connection bar 11' at which the most lowest inserting head section 6 of an allay of a plurality of the inserting head sections 6, is disposed on the connection bar 11', with an appropriate length.

On the other hand, it is also preferable that at an-opposite end portions of each one of the connection bars 11 and 11', there are other end portions of each one of the connection bars 11 and 11', which being opposite to each one of the end portions of the connection bars 11 and 11' and each being provided with the guide portions 40 and 41, respectively, no extended portion as mentioned above is provided and a position of the end portion of each one of the connection bars should be disposed closely adjacent to a position at which the inserting head section 6 locating at the most end portion in the and alley of the inserting head sections 6, or the socket section 8 locating at the most end portion in the alley of the socket sections 8, is disposed. end portion in the alley of the socket sections 8, is disposed.

In the present invention, by using this configuration as mentioned above, it becomes possible that an operator can easily decide which end portion of one of the connection bars 11 or 11' of the fastening element 4, should be inserted into which one of the connection bar inserting slits 31 or 32 formed on the attaching gun 10 and accordingly, the working efficiency thereof is improved as well as the generations of malfunctions of the attaching gun 10 due to such insertion mistake of the connection bar or the generations of jamming are significantly reduced.

Further, in the fastening element 4 of the present invention, it is also preferable that at least one of an external configuration, a length, an cross-sectional configuration, a color of the second connection bar 11' which a plurality of the inserting head sections 6 are connected, or the guide portion 40 of the second connection bar 11' is different from that of the first connection bar 11 to which a plurality of the socket sections 8 are connected or the guide portion 41 of the first connection bar 11.

On the other hand, the fastening element 4 of the present invention is especially effective when it is used with an attaching gun for shooting each one of the unit fastening elements against a good or a product, which is disclosed in the specification of the Japanese Patent Application Number 2000-131967 for which the inventor of the present invention is one of the co-inventors.

And further, in the present invention, it is also a preferable embodiment in which, as shown in FIGS. 1 to 4, at least a part of the curved configuration 21 of each one of the plurality of the filament sections 5 is overlapped with at least a part of the curved configuration 21 of other filament section 5 adjacently arranged thereto each other, whereby the fastening element is provided with a flat like portion 30 formed by a plurality of the curved configurations 21 of each one of the filament sections 5, at least a part of which are partly overlapped with each other.

Due to this configuration as mentioned above, the flat portion 30 of the present invention can show a rigid condition with keeping each one of the filament sections 5 in an independent and easily separable condition from other filament sections 5 being adjacently arranged thereto.

Accordingly, even when the flat portion 30 comprising a plurality of the unit fastening elements 5 of one fastening element 4 is contacted to a separate flat portion 30 comprising a plurality of the unit fastening elements 5 of another fastening element 4, a problem in that each of the filament section 5 of one fastening element 4 is inserted into among the filament section 5 which are consisting the flat portion 30 of another fastening element 4 so as to cause both of the filament section 5 to be entangled with each other, can be avoided.

And further, in the fastening element 4 of the present invention, when the filament section 5 is bent to form a curved configuration, the direction for bending it is also possible to be a direction so that the connection bars 11 and 11' are located inside the curved configuration but in the preferable embodiment, the socket sections and the inserting head sections are sandwiched between the first and second connection bars each being oppositely arranged to each other, in the curved filament section 5.

With these configuration of the present invention, the problem in which each of the inserting head sections 6 or the socket sections 8 of one fastening element 4 is inserted among the filament section 5 of another fastening element 4 adjacently arranged thereto, so as to cause the filament section 5 and either one of the inserting head sections 6 or the socket sections 8 to be entangled with each other, can also be eliminated, completely.

By implementing this, a distance formed between side wall portions of two socket sections 8 each being adjacently arranged to each other, should preferably be set at a width shorter than the smallest diameter of each one of the inserting head section 6.

While, in the present invention, by using the fastening element 4 having the above-mentioned configuration, it is possible to provide a package 50 for containing the fastening elements 4 in which a plurality of the fastening elements 4 are contained therein so that a plurality of the fastening elements 4 are stacked one on each other or adjacently arranged in contacting condition to each other with a condition in that the connection bars 11and 11' of each one of the fastening elements 4 are arranged in parallelism with those of another fastening element adjacently arranged thereto.

On the other hand, when the fastening element 4 is mounted on the attaching gun 10, since the distance formed between both connection bars 11 and 11' of the fastening element 4 can be kept always uniform, the problem as in the past can be resolved in which the distance formed between both connection bars 11 and 11' of the fastening element 4 is outwardly expanded gradually as a height thereof from a top surface of the attaching gun increases causing to be an interruption for working operation of an operator.

Hereunder, a result of the experiments for shooting tests between the fastening element 4 of the present invention and those in the past is explained with reference to Table 1.

Figure 5:
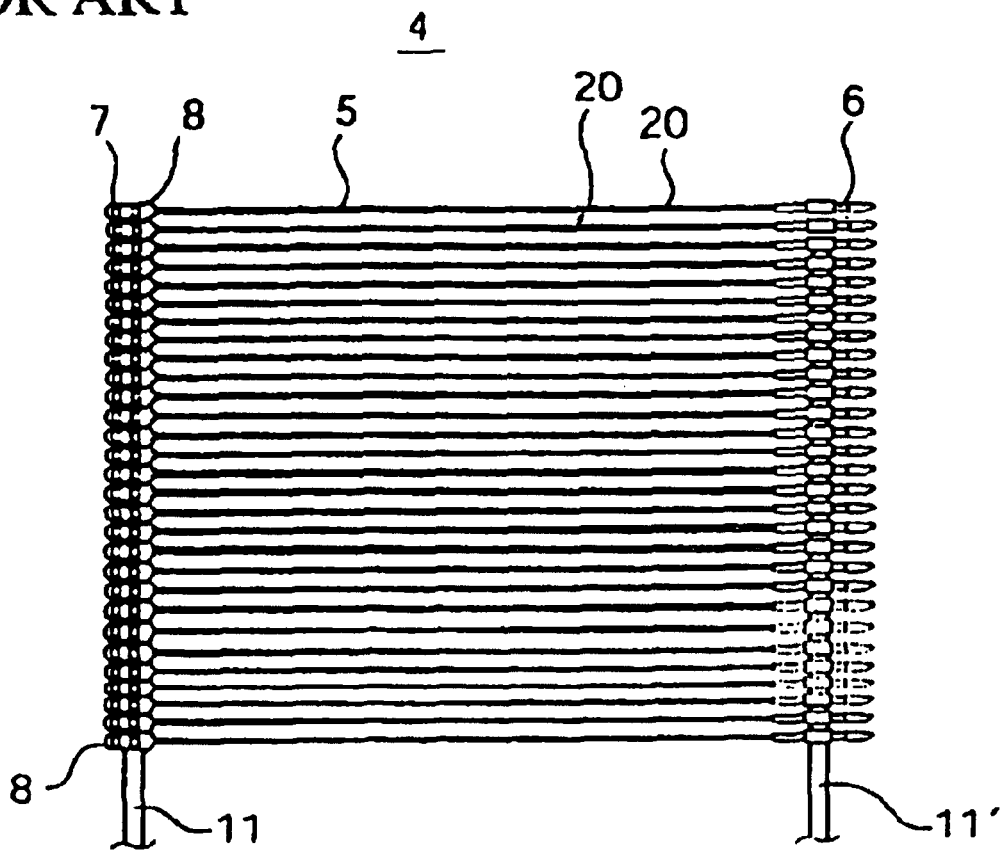
Fig. 5 PRIOR ART
FIG. 5 is a plane view showing one example of the conventional fastening element.
Figure 6A:
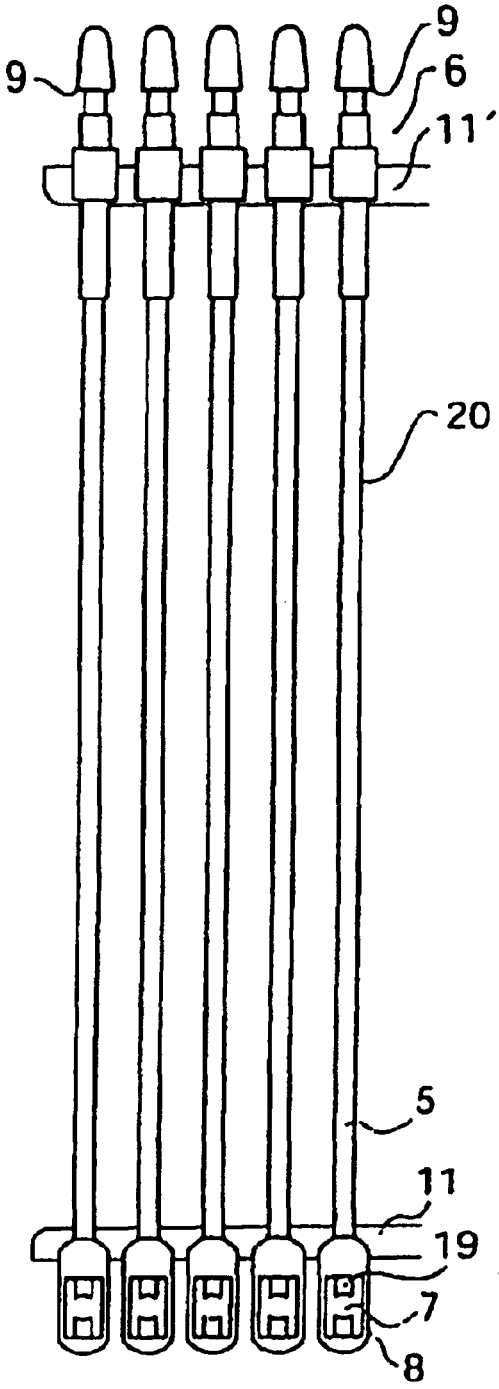
FIGS. 6(A) to 6(C) are drawings illustrating one example of a configuration of one unit fastening element of the conventional fastening element.
Figure 6B:
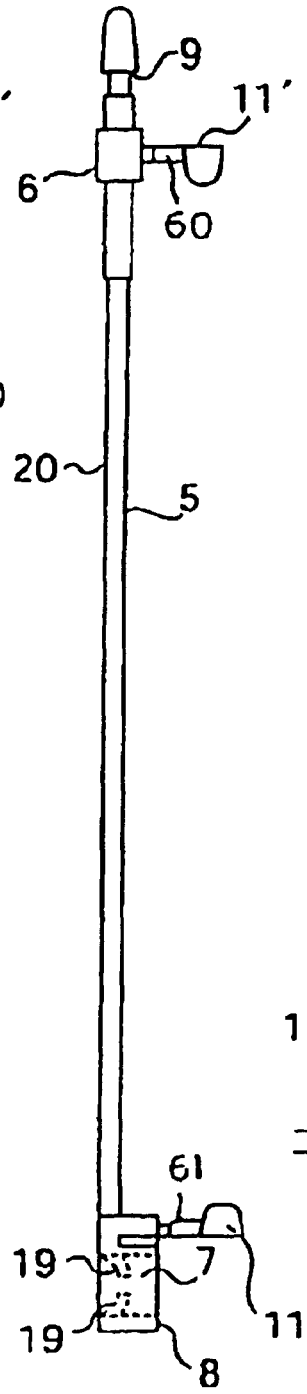
Figure 6C:
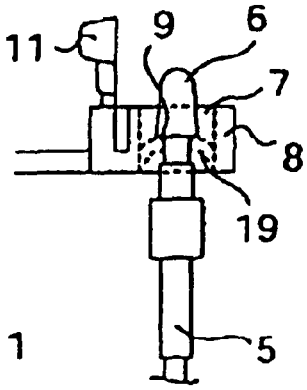
Fig. 6(C) PRIOR ART

In the experiments, the fastening elements 4 of the present invention as shown in FIG. 1 and the conventional fastening element 4 as shown in FIG. 5 each being make of the same material and having the same dimension and same pitch as each other.

Under this experiments, 5 operators were given the same attaching gun 10, respectively and each having carried out the unit fastening element shooting test utilizing the fastening element 4 having 50 of the unit fastening elements 20 each of which being arranged in parallelism with each other and fixed by both connection bars 11 and 11' as the past sample and the fastening element 4 of the present invention having the same configuration as of the past sample but having a bent configuration in the filament section 5, respectively.

The test results are shown in the Table 1.

Note that, in this test as shown in the Table 1, each one of the 5 operators such as OPERATOR No. 1 to No. 5, had tried to shoot the respective 50 numbers of the unit fastening elements 20 which are fixed by both connection bars to form a configuration as shown in FIG. 5 (referred to as "a straight pin" in Table 1), three times, so that each operator had shot 150 of the unit fastening elements, respectively.

While, each one of the operators had also tried to shoot the respective 50 numbers of the unit fastening elements 20 which are fixed by both connection bars to form a configuration as shown in FIG. 5, but further each of the filament sections having a curved configuration so as to be shown in FIG. 1 (referred to "a curved pin" in Table 1), three times, so that each operator had shot total of 300 of the unit fastening elements, respectively.

The Table 1 shows a result of an analysis about problems as appeared by these experiments.

Note that, in Table 1, the data as shown in the column labeled by the term of "a straight pin" and "a curved pin" means that the results of the test in which the successive shooting operation for 50 numbers of the straight pins followed by the successive shooting operation for 50 numbers of the curved pins so that the successive shots for the 50 of straight pins and the successive shots for the 50 of the curved pins are carried out, alternatively.

According to the experiments, in any one of the tests as mentioned above, no entanglement due to an incomplete setting operation at an initial stage had been generated during its shooting operations.

In addition, in the Table 1, the term of "entanglement" denotes a condition in which when the fastening element is mounted on the attaching gun and the shooting operation for each one of the unit fastening elements is carried out, a filament section of one of the unit fastening element of one fastening element is entangled with one or a plurality of the filament sections of the unit fastening elements of the separate fastening element being adjacently arranged thereto so that the shooting operation to shot the unit fastening element becomes impossible or a condition in that separate operation for taking out from the attaching gun, the unit fastening element which is failed to be shot out therefrom, should be done.

And further, in the Table 1, the term of "Incomplete coupling" denotes a condition in which, although an operation lever of the attaching gun had been actuated, the inserting head section 6 cannot be coupled with the socket section 8 due to the inserting head section 6 being displaced out of its original passage.

On the other hand, in the Table 1, the term of "lack of gripping" denotes a condition in which due to the working lever of the attaching gun not having been completely pushed to the final destined position thereof, the inserting head section 6 cannot completely be coupled with the socket section 8 so that incomplete transfer of the unit fastening element, had occurred.

More over, in the Table 1, the term of "Incomplete set" denotes the condition in which after when the above-mentioned problems have been occurred and when the fastening element is reset to be mounted on the attaching gun, the resetting operation had not been done correctly, (especially on a side for the inserting head section), so that the inserting head section 6 and the socket section 8 cannot completely be coupled with each other.

As seen from the results thereabout shown in the Table 1, when the fastening element 4 having a conventional configuration had been used, 47 troubles had actually been generated and especially, it can be understood that a number of the generations of incomplete operations due to the entanglements is remarkably large. However, when the fastening element 4 of the present invention had been used, no entanglement had been generated and a slightly small number of incomplete transfer due to a lack of gripping had only been generated.

Accordingly, in the present invention, it is understandable that the problem caused by the entanglement had completely been resolved.

Although in the present invention, it can be seen that a small number of problems due to the incomplete gripping had been generated, these problems were mainly generated based upon the operator's lack of experience in using this kind of attaching gun or based upon so called a feeling of hesitation in handling the new type of an attaching gun at an initial operation works, and thus this problem did not seem to be a substantial matter.

In the present invention, until when the fastening element is about to be mounted on the attaching gun, a plurality of the fastening element which have been produced in a factory are contained into an appropriate containers or packages and shipped and transferred therefrom to a field site at which each one of the unit fastening elements is shot so as to be attached to a prescribed product or good with a prescribed label.

At this field site, each one of operators takes up each one of the fastening elements from the prescribed container or package, one by one so that the mounting operation for mounting the fastening element on the attaching gun, is carried out.

During this operation, there exist a lots of problems as mentioned above, related to the entanglement generated among the fastening elements, in the past, and accordingly, in the past, significantly long working times for de-entanglement of the entangled fastening elements had been spent causing the working efficiency thereof to be remarkably reduced.

On the other hand, in the present invention, as mentioned above, since the fastening element 4 has an approximately flat configuration, even when a plurality of the fastening elements 4 are inserted into a package 50 for the fastening elements with a stacked formation or with an arbitrary formation, they can be easily contained without showing a bulked condition and thus they can be easily contained or kept inside the container or package 50.

On the other hand, in the present invention, since the fastening element 4 of the present invention is characterized in that among a plurality of the filament sections 5 consisting one of the fastening element 4, no other filament sections 5 consisting another fastening element 4 can be inserted there into or none of the inserting head section 6 or the socket section 8 of one of the fastening element 4, can be entangled with a filament sections 5 consisting another fastening element 4, even when a plurality of the fastening element 4 are held inside the container in a form of an appropriate stacked formation or the like, no entanglement among the filament section would be raised between the filament sections or between the filament section and either one of the inserting head section 6 or the socket section 8, would have been occurred in the package.

Accordingly, even when one of the fastening element 4 is about to be taken out of the package, it can be easily taken out therefrom without generating any entanglement among the fastening elements.

Figure 8A:
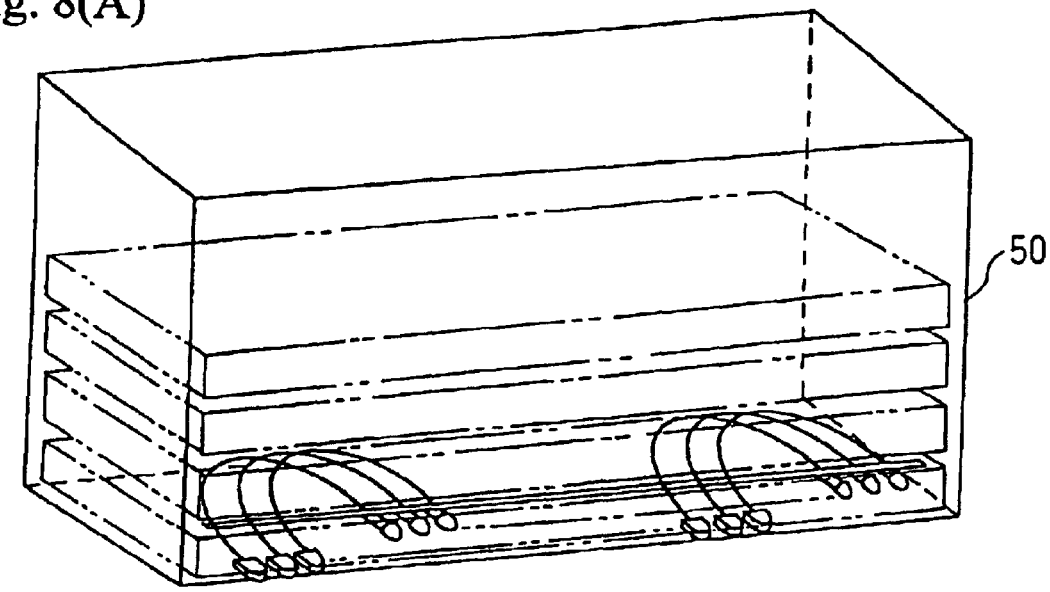
FIG. 8(A) is a drawing showing a configuration of one embodiment of a package for containing the fastening element of the present invention.

In a separate embodiment of the present invention as shown in FIG. 8(A), a package 50 is a container having a vertical type main body and in that a plurality of the fastening element 4 are stacked inside the package in a laterally arranged formation with both of the connection bars 11 and 11' being arranged in parallelism with each other.

When a plurality of the fastening element 4 are kept inside a prescribed package, as shown in the FIG. 8, a cartridge-type package having a rectangular form with a narrow width can be conveniently used.

Figure 8B:
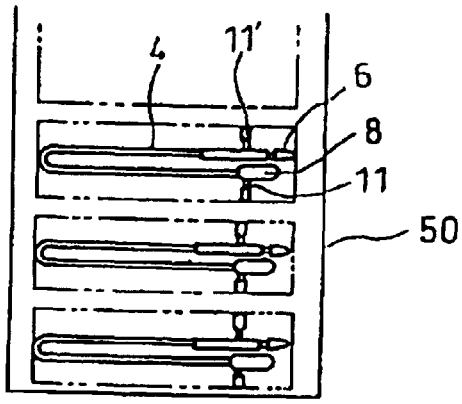
FIGS. 8(B) and 8(C) are detailed views taken inside the package of FIG. 8(A).

Further, when a plurality of the fastening elements 4 are kept inside a prescribed package 50, as shown in the FIG. 8(B), it is possible to insert the plurality of the fastening elements 4 into the package 50 by adjusting an inserting direction thereof so that a connection bars 11 of one of the fastening element 4 is overlapped with or is closely arranged to other connection bar 11 of a separate fastening elements 4' adjacently arranged thereto.

Figure 8C:
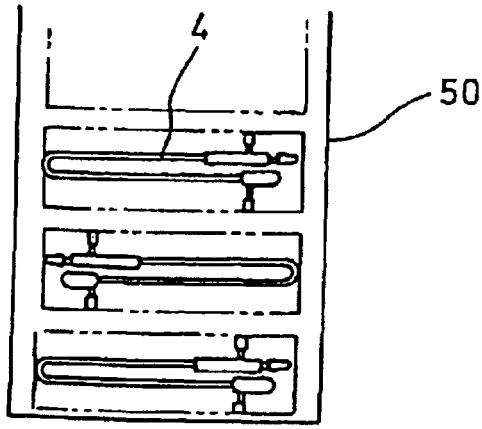

However, as shown in the FIG. 8(C), it is also possible to insert the plurality of the fastening elements 4 into the package 50 by adjusting an inserting direction thereof so that a connection bars 11 of one of the fastening element 4 is arranged at a position opposite to a position at which another connection bar 11 of a separate fastening elements 4' adjacently arranged thereto, is arranged, in an alternate configuration, for example, with one by one formation or with another formation in that a group of a prescribed number of the fastening elements and an other group of a prescribed number of the fastening elements which is the same as or different from that of the former group, are alternatively arranged.

Note that, in the present invention, it is also a preferable embodiment in that in a case of a plurality of the fastening elements 4 are contacted with each other, the package for the fastening elements should be made so that a position at which the connection bar 11 of the first fastening element is disposed, is different from a position at which the connection bar 11 of the second fastening element being different from the first fastening element, is disposed.

Figure 9:
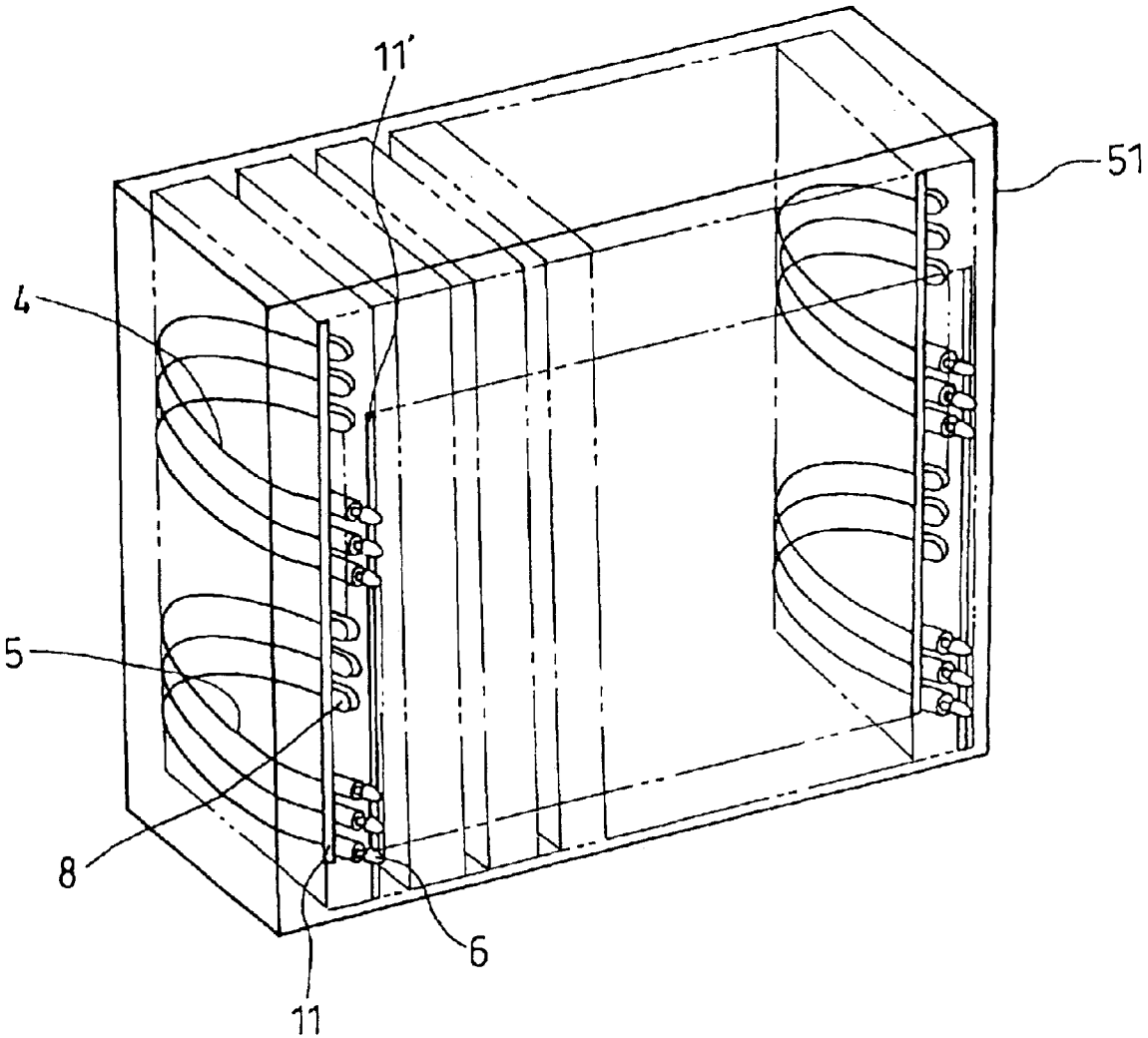
FIG. 9 is a drawing showing a configuration of another embodiment of a package for containing the fastening element of the present invention.

While, FIG. 9 shows a separate configuration of the package 51 for the fastening element as another embodiment of the package therefor.

As understood from the FIG. 9, the package 51 for the fastening element is a vertical typed package therefor, and thus a plurality of the fastening element 4 are inserted into this package 51 vertically in upright configuration with their connection bars 11 and 11' are arranged in parallelism with each other.

In this embodiment, it is also a preferable embodiment in that in a case of a plurality of the fastening elements 4 are contacted with each other and each being adjacently and vertically arranged to each other, inside the package, the package for the fastening elements should be made so that a position at which the connection bar 11 of the first fastening element is disposed, is different from a position at which the connection bar 11 of the second fastening element being different from the first fastening element, is disposed or the package for the fastening elements should be made so that a position at which the connection bar 11 of the first fastening element is disposed, is set at the same position at which the connection bar 11 of the second fastening element being different from the first fastening element, is disposed.

When a plurality of the fastening elements 4 are kept inside the prescribed package in accordance with the present invention, as shown in the above-mentioned drawings, it is convenient that a cartridge-type package having a rectangular form with a narrow width is used.

By introducing the above-mentioned configuration for a package, it can be possible that the package can be attached to a belt or the like of an operator and each one of the fastening element 4 can be taken out easily from the package 50 or 51 at a field site depending upon its necessity by hand of the operator and it can be easily mounted on the attaching gun or the like. As explained above, by using the fastening element 4 of the present invention, since it is possible to completely eliminate the generation of troubles in that the inserting head section 6 or the socket section 8 of one of the fastening element 4 are prevented from being inserted into among the filament sections 5 consisting another fastening element 4 which is adjacently arranged thereto so as to generate such entanglement therebetween, as mentioned above, even when a plurality of the fastening element are contained in a package either in an arbitrary condition, for example, in a stacked condition or in a vertical side by side arrangement condition, a desired fastening element can be easily and smoothly singled out among the plurality of the fastening elements contained therein, without any entanglement therebetween.

Accordingly, the operation for mounting each one of the fastening elements on the attaching gun 10 becomes very easy for an operator as well as a size of the package for containing or storing a plurality of the fastening elements can be minimized so that a space for storing such packages or for wrapping the packages can be remarkably reduced causing the cost therefor to be reduced.

Next, as one example of a method for producing the fastening element 4 of the present invention, the following method can be preferably used.

Note that, such method is a method for producing a fastening element comprising a plurality of a unit fastening element arranged adjacently and in parallelism with each other, each of the unit fastening element comprising a filament section, an inserting head section equipped with a suitable engagement section located at one end of the filament section, and a socket section equipped with a hole for irreversibly passing the inserting head section located at the other end of the filament section, the fastening element characterized in that a plurality of the socket sections or their vicinities each being adjacently arranged to each other and a plurality of the inserting head sections or their vicinities each being adjacently arranged to each other, are temporarily and individually connected to each one of connection bars, respectively, wherein the method comprising;

arranging each of the connection bars closely to each other so as to be oppositely disposed to each other with a predetermined length displaced to each other along a longitudinal direction of the both connection bars; and applying a fixing treatment to each one of the unit filament sections of the respective fastening element with a compression force so that a flat surface formed by each one of the curved configuration of each one of the filament sections is set either substantially in parallelism with the longitudinal direction of the both connection bars or with a predetermined angle with the longitudinal direction thereof.

In the method for producing the fastening element of the present invention, the heat set treatment is not restricted to a specific treatment but it may preferably be a heat set treatment for one example, and be a method for reducing the filament section into a curved configuration with an appropriate fixing substance, for another example.

Figure 10:
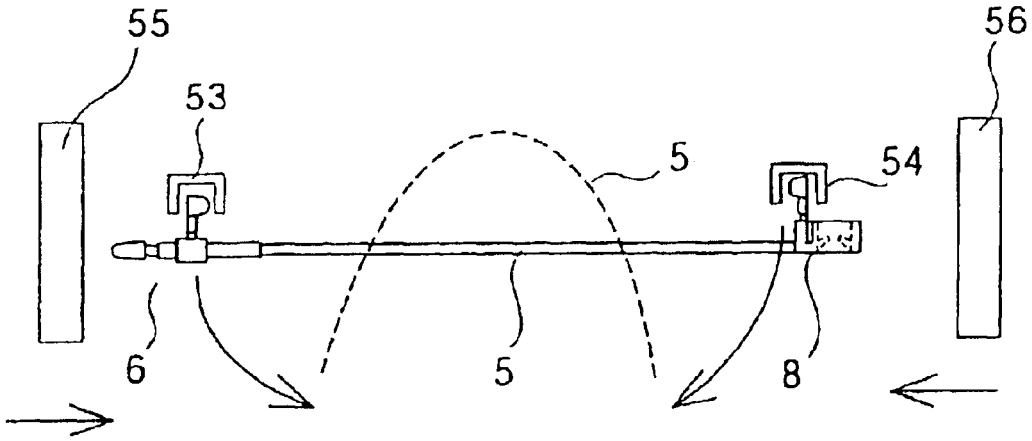
FIG. 10 is a drawing showing a configuration of one example of a device for producing the fastening element of the present invention.
Figure 11:
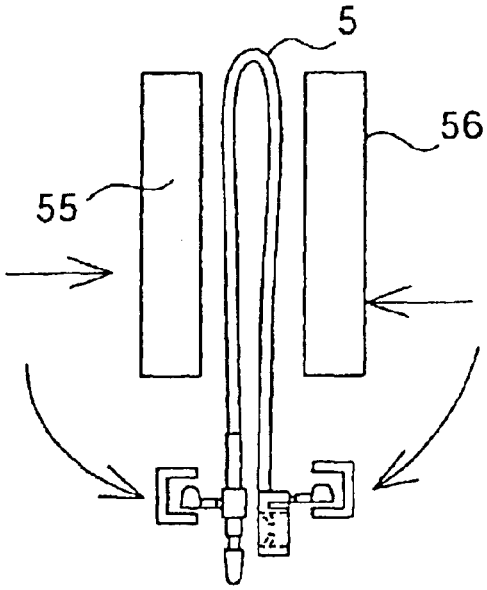
FIG. 11 is a drawing showing a configuration of another example of a device for producing the fastening element of the present invention.
Figure 12:
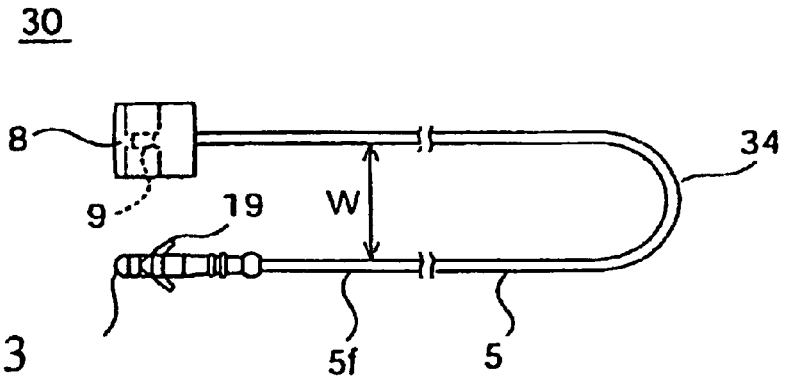
Fig. 12 PRIOR ART
FIG. 12 is a drawing showing a configuration of a separate embodiment of the unit fastening element of a conventional fastening element.
Figure 13:
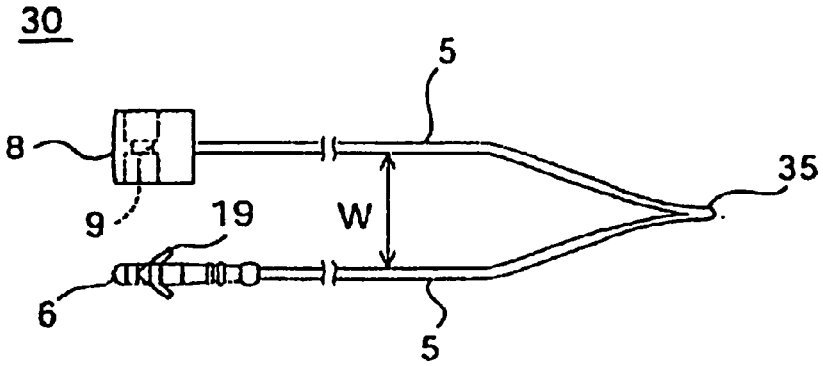
Fig. 13 PRIOR ART
FIG. 13 is a drawing showing a configuration of a different embodiment of the unit fastening element of a conventional fastening element.
Figure 14:
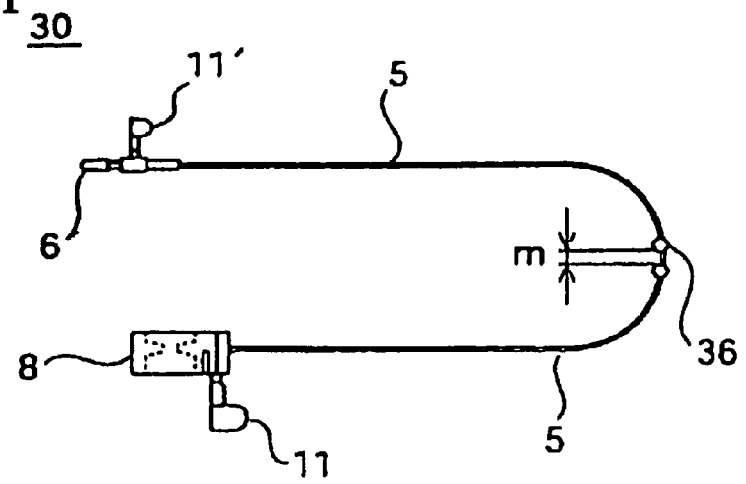
Fig. 14 PRIOR ART
FIG. 14 is a drawing showing a configuration of a further different embodiment of the unit fastening element of a conventional fastening element.

As one of the preferable embodiments for producing the fastening element in the present invention, for example, as shown in FIG. 10 and FIG. 11, the method comprises the steps of;

gripping a pair of the connection bars 11 and 11' by an appropriate clippers 53 and 54;

transferring the clippers 53 and 54 with twisting thereof so that both clippers 53 and 54 as well as the inserting head section 6 and the socket section 8 are closely and oppositely arranged to each other;

forming a curved like configuration such as an appropriate loop on each one of the filament section 5 which consisting the fastening element 4;

after that, displacing one of the connection bars 11 and 11' which being closely and oppositely arranged to each other, along a longitudinal direction of the fastening element 4, with a prescribed length against the another connection bar, so that each one of a flat surfaces formed by the respective curved filament section 5 is arranged with each other in a flat plane configuration or with a slightly tapered configuration in a condition in that at least a part of each one of the flat surfaces thereof is overlapped with a part of the flat surface of separate filament section 5 which being adjacently arranged thereto, with keeping the condition in which each one of the flat surfaces formed by the respective curved filament section 5 is arranged in parallelism with each other, whereby a plurality of the flat surfaces formed by the respective filament section 5 having the curved configuration 21 totally form an approximate flat section 22; and heat-setting the flat section 22 consisting a plurality of flattened curved filament sections 6 of the fastening element 4 utilizing an appropriate fixing means, for example, which is provided with a pair of heating plates 55 and 56 enabling to be opened or to be closed or enabling to be contacted with each other, and heated at an appropriate temperature, respectively, so that the flat section 22 thereof is sandwiched between the heating plates 55 and 56 by contacting them each other and heat setting operation is carried out.

Of course, in the present invention, the heat setting operation for the curved filament section 5 is not restricted only to the dry heat setting method but wet heat setting method can also be used.

Therefore, specifically in the present invention, the configuration of the flattened filament section 5 of the fastening element 4 can be set as it is by heating and pressing the flattened filament section 5 by an appropriate heating members.

Hereunder, another embodiment of the fastening element 4 of the present invention will be explained with reference to FIGS. 15 to 17.

Note that this embodiment is basically identical to the above-mentioned embodiment of the present invention in the basic configuration thereof and the basic method for producing the questioned fastening element 4.

However, the above-mentioned embodiments is mainly focus on the fastening element 4 which can be used with a specially designed attaching gun 10, mechanically.

And thus the connection bars 11 and 11 are relatively hard and rigid so as to keep its configuration on the attaching gun 10 and also the connecting portions 60 and 61 formed between each one of the connection bars and each one of the inserting head section or socket sections 8, are hard and strong so as to be separated by a cutter provided on the attaching gun 10.

Figure 15:
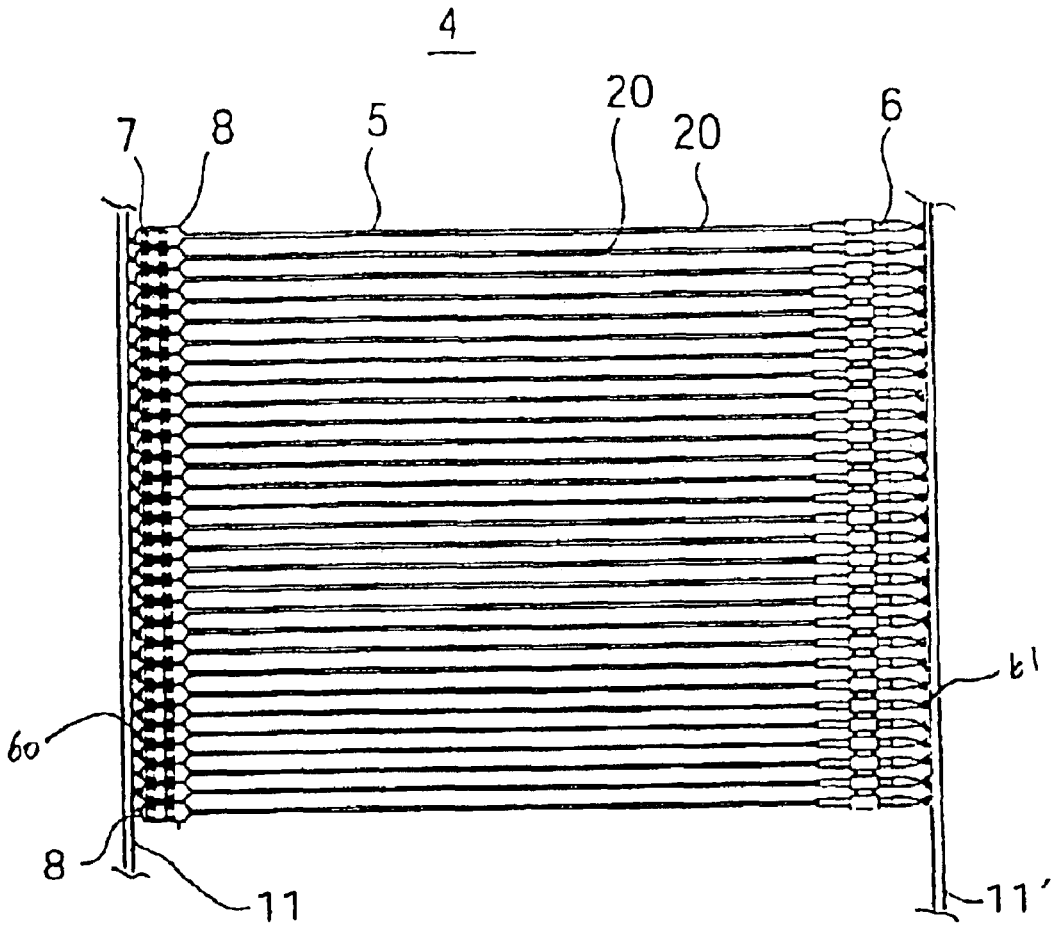
FIG. 15 is a drawing showing a configuration of a further separate embodiment of a basic fastening element of the present invention.
Figure 16:
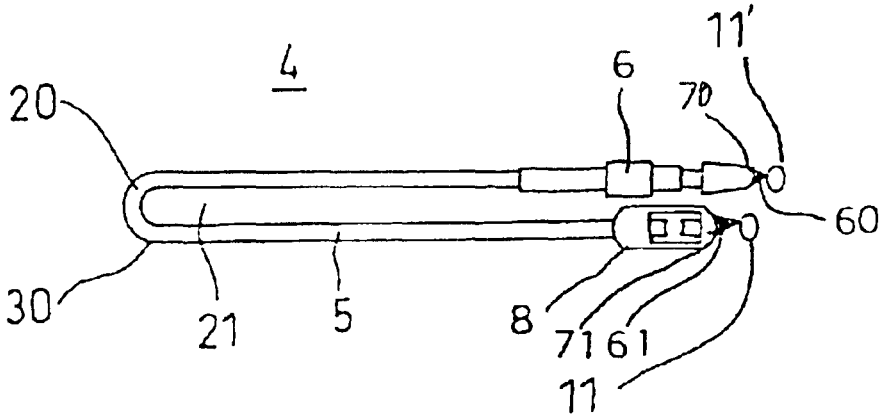
FIG. 16 is a cross-sectional view showing the separate embodiment of the fastening element of the present invention based upon the basic configuration as shown in FIG. 15.
Figure 17:
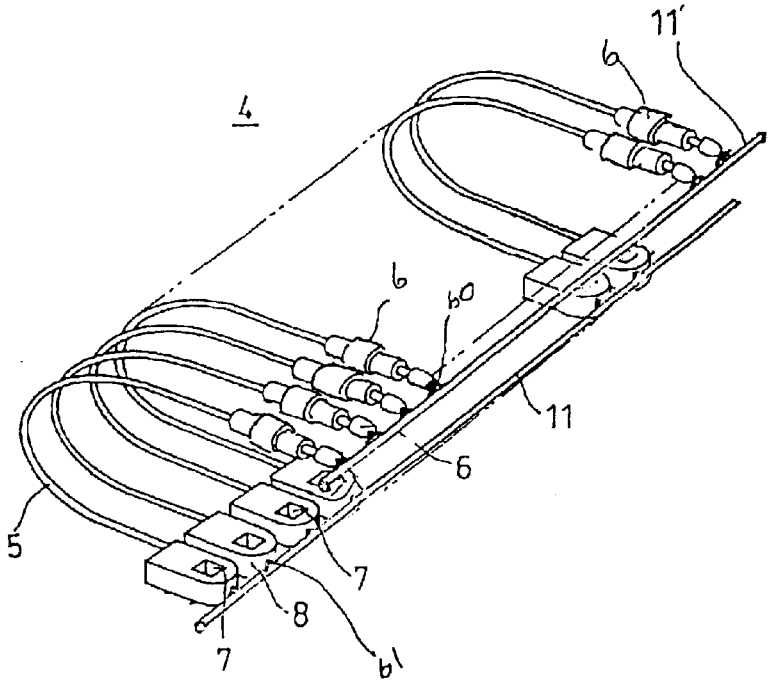
FIGS. 17(A) and 17(B) are perspective views showing the separate embodiment of the fastening element of the present invention as shown in FIG. 16.
Figure 17:
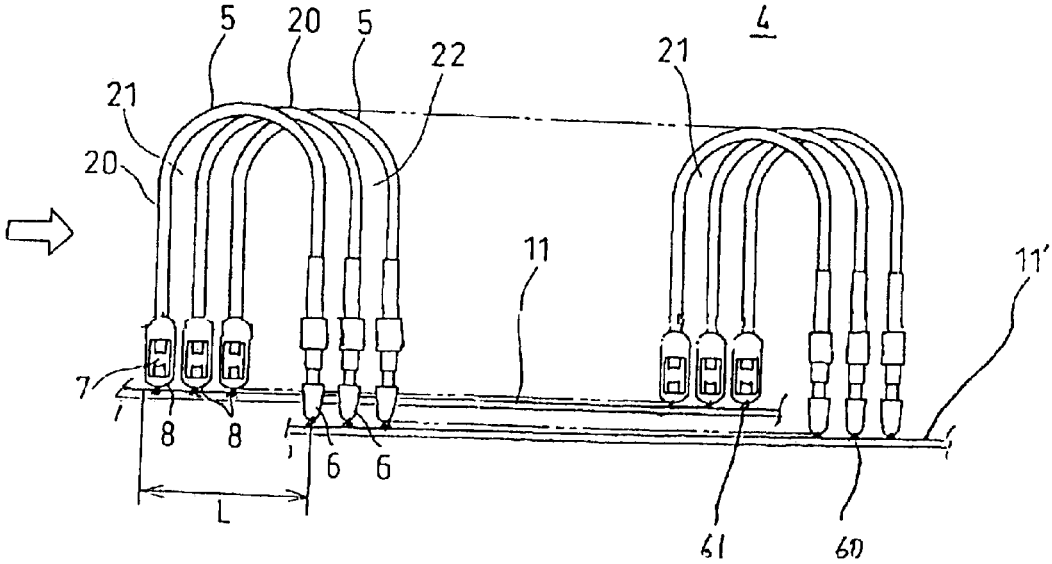

On the other hand, the separate embodiment of the present invention as shown in FIGS. 15 to 17 provides a fastening element 4 which can be used by an operator with his, hands and thus each one of the unit fastening elements 6 can be separated from the connection bars, easily by hands of the operator.

Accordingly, in this embodiment, each one of the connection bars 11 and 11' is made of a filament like fine member and each one of the inserting head sections 6 and the socket sections 8 are easily and separably connected to either one of the connection bars 11 and 11', respectively, by hand.

Note that in this embodiment, as shown in FIG. 15, one of the connection bars 11 is connected to each one of the outer most end portion 70 of the inserting head sections 6 of the filament sections 5 each forming the fastening element 4, while another connection bars 11' is connected to each one of the outer most end portion 71 of the socket sections 8 of the filament sections 5 each forming the fastening element 4.

Further in this embodiment, after the heat pressing operation had been applied the fastening element 4 of this embodiment, as shown in FIG. 16, the socket section and the inserting head sections 8 are closely and adjacently arranged with each other as well as the connection bars 11 and 11' are directly facing to and adjacently arranged with each other through each one of the curved filament sections 5.

On the other hand, a perspective configuration of this embodiment of the present invention is shown in FIG. 17.

Please note that in this embodiment, the connection bars 11 and 11' is somewhat soft and weak comparing that of the above mentioned embodiments of the present invention, so as to enable to be contained much more numbers of the fastening element 4 in a package having a restricted capacitor.

And further, the connecting portions 60 are integrally formed with the inserting head sections 6 and the connection bar 11 and the connecting portions 61 are integrally formed with the he socket sections 8 and the connection bar 11', respectively with one molding operation of the fastening element 4.

Moreover, in this embodiment, the connecting portions 60 and 61 have a strength so as not to be broken under forces generated during the time when the fastening element 4 is produced, is transferred, is taken up from a package or is mounted on the attaching gun but so as to be easily broken by a hand work of an operator.

Therefore, under this embodiment, the operator will work to separate one of the filament section 6 from the fastening element 4 and pass one of the ends portion of this filament section 5 through a good with tag or label and will couple the inserting head section 6 with the socket section 8 by his hands. Since the present invention adopts the configurations as described above, the present invention is able to provide various remarkable operational effects.

For example, since in the fastening element 4 of the present invention, each one of the filament sections 5 is previously bent, when it is mounted on an appropriate attaching gun which is a device being able to continuously couple the fastening element with a good by pulling a operation lever, the mounting operation or setting operation of the fastening element becomes very easy due to no specific bending or curving operation being required to match the fastening element to a configuration of such gun.

Further, in the present invention, since the filament sections of the fastening element had already bent, it is possible to minimize a size in width direction of the attaching gun and in addition thereto, the occasion in that the above-mentioned jamming would be generated can be remarkably reduced.

And further, as mentioned above, in the conventional flat type fastening element, an operator should mount the fastening element on the attaching gun mainly used for this fastening element with simultaneously performing the bending operation on the flat type fastening element causing the mounting operation to be complicated, however, in the present invention, the fastening element can simply be mounted on the attaching gun as it is without doing any other operation.

More over, in the conventional fastening element, there must be a danger in that an operator would mount fastening element on the attaching gun with erroneously bending the flat type fastening element in an opposite direction to the correct one, however, in the present invention, since the inserting head section and the socket section of the fastening element are provided thereon with facing to correct directions, respectively, so that no mistake would be occurred in mounting the fastening element on the attaching gun.

In addition to the above-mentioned effects, in the present invention, the generation of entangled condition among the filament sections is completely prevented and when the fastening element had been mounted on the attaching gun, the shooting operation for shooting each one of the unit fastening elements can also be performed smoothly so that the generation of the jamming condition can also be prevented, previously.

By using the fastening element of the present invention, since it is possible to completely eliminate the generation of troubles in that the inserting head section 6 or the socket section 8 of one of the fastening element 4 are prevented from being inserted into among the filament sections 5 consisting another fastening element 4 which is adjacently arranged thereto so as to generate such entanglement therebetween, as mentioned above, even when a plurality of the fastening element are contained in a package either in an arbitrary condition, for example, in a stacked condition or in a vertical side by side arrangement condition, a desired fastening element can be easily and smoothly singled out among the plurality of the fastening elements contained therein, without any entanglement therebetween.

Accordingly, the operation for mounting each one of the fastening elements on the attaching gun 10 becomes very easy for an operator as well as a size of the package for containing or storing a plurality of the fastening elements can be minimized so that a space for storing such packages or for wrapping the packages can be remarkably reduced causing the cost therefor to be reduced.

What is claimed is:

1. A fastening element comprising a plurality of a unit fastening elements arranged adjacently and generally parallel to each other, each of the unit fastening element comprising a filament section, an inserting head section equipped with a suitable engagement section located at one end of the filament section, and a socket section equipped with a hole for irreversibly passing said inserting head section located at said other end of said filament section, said fastening element characterized in that a plurality of said socket sections or their vicinities are each adjacently arranged to each other and a plurality of said inserting head sections or their vicinities and each adjacently arranged to each other, and are temporarily and individually connected to each one of connection bars, respectively, said inserting head sections and said socket sections being displaced with respect to each other along a longitudinal direction of said connection bars, said filament section of each one of said unit fastening elements being formed in curved configuration which is in fixed condition, wherein each of said connection bars are closely arranged to each other.

2. A fastening element according to claim 1, wherein a flat surface formed by each one of said curved configuration of each one of said filament sections is set either substantially in parallelism with said longitudinal direction of said both connection bars or with a predetermined angle with said longitudinal direction thereof.

3. A fastening element according to claim 1 or 2, wherein each one of said filament sections is heat set.

4. A fastening element according to any one of claim 1 or 2, wherein said filament section is made of a synthetic material which can be set with heat.

5. A fastening element according to any one of claims 1 to 2, wherein, when said both connection bars are held in vertical direction, the most lowest end portion of one of said connection bars is put on a position below a position of the most lowest end portion of another said connection bar.

6. A fastening element according to any one of claims 1 to 2, wherein a first guide portion is provided at least at one end portion of said connection bar to which a plurality of said inserting head sections are connected, said first guide portion having a predetermined length to which none of said inserting head section is connected.

7. A fastening element according to claim 6, wherein, said connection bar to which a plurality of said socket sections are connected, is provided with a second guide portion having a predetermined length shorter than that of said first guide portion, and to which none of said socket section is connected, at least at one end portion thereof or said connection bar is not provided with said second guide portion at least at one end portion thereof.

8. A fastening element according to claim 7, wherein, when said both connection bars are held in vertical direction so that said first guide portion is directed downwardly, said most lowest end portion of said first guide portion of a second connection bar to which a plurality of said inserting head sections are connected, is put on a position identical to a position to said most lowest end portion of said second guide portion of a first connection bar to which a plurality of said socket sections are connected, or below a position of said most lowest end portion of said first guide portion.

9. A fastening element according to any one of claim 1 or 2, wherein at least a part of said curved configuration of each one of said filament sections is overlapped with at least a part of said curved configuration of other filament section adjacently arranged thereto each other.

10. A fastening element according to claim 9, wherein said element is provided with a flat like portion formed by a plurality of said curved configurations of each one of said filament sections, at least a part of which are partly overlapped with each other.

11. A fastening element according to any one of claim 1 or 2, wherein said socket sections and said inserting head sections are sandwiched between said first and second connection bars each being oppositely arranged to each other.

12. A fastening element according claim 8, wherein at least one of an external configuration, an cross-sectional configuration and a color of said second connection bar to which a plurality of said inserting head sections are connected or a length of said first guide portion of said second connection bar is different from that of said first connection bar to which a plurality of said socket sections are connected.

13. A package for containing fastening elements wherein a plurality of said fastening elements as defined by any one of said above-mentioned claim 1 or 2, are contained therein so that a plurality of said fastening elements are stacked one on other or adjacently arranged in a contacting condition to each other whereby each one of said fastening elements being contacted to each other with a condition in that said connection bars of each one of said fastening elements are arranged in parallelism with those of another fastening element adjacently arranged thereto.

14. A package for containing fastening elements according to claim 13, wherein among a plurality of said fastening elements each being adjacently attached to each other, a position at which said connection bars of a first fastening element is disposed is different from a position at which said connection bars of a second fastening element being different from said first fastening element, is disposed.

15. A fastening element according to any one of claim 1 or 2, wherein, each one of said connection bars is made of a filament like fine member and each one of said inserting head sections and said socket sections are easily and separably connected to either one of the connection bars, respectively, by hand.

16. A fastening element according to claim 15 wherein one of said connection bars is connected to each one of the outer most end portion of said inserting head sections of the filament sections each forming said fastening element, while another connection bars is connected to each one of the outer most end portion of said socket sections of the filament sections each forming said fastening element.

17. A fastening element according to claim 15, wherein said socket sections, and said inserting head sections are closely and adjacently arranged with each other as well as said connection bars are directly facing to and adjacently arranged with each other through each one of said curved filament sections.

18. A method for producing a fastening element comprising a plurality of a unit fastening elements arranged adjacent and generally parallel to each other, each of said unit fastening elements comprising a filament section, an inserting head section equipped with a suitable engagement section located at one end of said filament section, and a socket section equipped with a hole for irreversibly passing said inserting head section located at said other end of said filament section, said fastening element characterized in that a plurality of said socket sections or their vicinities are each adjacently arranged to each other and a plurality of said inserting head sections or their vicinities are each adjacently arranged to each other, and are temporarily and individually connected to each one of connection bars, respectively, wherein said method comprising;

arranging each of said connection bars closely to each other, arranging said inserting head section and said socket section so as to be displaced with respect to each other along a longitudinal direction of said connection bars; and applying a fixing treatment to each one of said unit filament sections of the respective fastening element with a compression force.

19. A method for producing a fastening element according to claim 18, wherein said fixing treatment with said compression force is carried out so that a flat surface formed by each one of said curved configuration of each one of said filament sections is set either substantially in parallelism with said longitudinal direction of said both connection bars or with a predetermined angle with said longitudinal direction thereof.

20. A method for producing a fastening element according to claim 18 or 19, wherein said fixing treatment is a heat set treatment.

21. A method for producing a fastening element according to any one of claims 18 to 19, wherein at least a part of said curved configuration of each one of said filament sections is overlapped with at least a part of said curved configuration of other filament section adjacently arranged thereto, each other.

* * * * *

UNITED STATES PATENT AND TRADEMARK OFFICE

CERTIFICATE OF CORRECTION

PATENT NO. : 6,848,575 B2
DATED : February 1, 2005
INVENTOR(S) : Hideyuki Ueno

It is certified that error appears in the above-identified patent and that said Letters Patent is hereby corrected as shown below:

Column 8,
Line 52, delete “an-opposite” and insert -- opposite --.

Column 11,
Line 64, delete “when”.

Signed and Sealed this

Fourth Day of October, 2005

JON W. DUDAS
*Director of the United States Patent and Trademark Office*